US005906518A

United States Patent [19]

Sun

[11] Patent Number: 5,906,518

[45] Date of Patent: May 25, 1999

[54] ELECTRICAL CONNECTOR AND CONNECTOR ASSEMBLY

[75] Inventor: Ming-shen Martin Sun, Hsin Chu, Taiwan

[73] Assignee: The Whitaker Corporation, Wilmington, Del.

[21] Appl. No.: 08/945,373

[22] PCT Filed: Apr. 10, 1996

[86] PCT No.: PCT/US96/04870

§ 371 Date: Oct. 10, 1997

§ 102(e) Date: Oct. 10, 1997

[87] PCT Pub. No.: WO96/32831

PCT Pub. Date: Oct. 24, 1996

[30] Foreign Application Priority Data

Apr. 18, 1995 [JP] Japan ..... 7-116310

[51] Int. Cl.[6] ..... H01R 17/00

[52] U.S. Cl. ..... 439/660; 439/295

[58] Field of Search ..... 439/660, 284, 439/293, 295, 79, 80

[56] References Cited

U.S. PATENT DOCUMENTS

| | | | |
|---|---|---|---|
| 2,124,207 | 7/1938 | Neesen | 173/332 |
| 4,737,118 | 4/1988 | Lockard | 439/289 |
| 4,986,772 | 1/1991 | Fukutani | 439/892 |
| 5,061,198 | 10/1991 | Manabe et al. | 439/293 |
| 5,098,311 | 3/1992 | Roath et al. | 439/295 |
| 5,167,528 | 12/1992 | Nishiyama et al. | 439/489 |
| 5,256,085 | 10/1993 | Tan et al. | 439/607 |
| 5,641,308 | 6/1997 | Bixler et al. | 439/660 |

FOREIGN PATENT DOCUMENTS

| | | | |
|---|---|---|---|
| 2648628 | 6/1990 | France | H01R 23/10 |
| OS 1490376 | 1/1969 | Germany . | |
| A-1-276575 | 4/1988 | Japan | H01R 13/64 |

*Primary Examiner*—Gary F. Paumen
*Assistant Examiner*—Briggitte R. Hammond

[57] ABSTRACT

The present invention is directed to a high density, miniature and low insertion force electrical connector assembly having a large number of contacts preferably in a plurality of rows. The electrical connector (10) comprises male and female contacts, 32) disposed alternatively in one or more rows of contact receiving cavities (21*a*–21*c*) in an insulating housing (20). The connector assembly comprises a pair of connectors having hermaphroditic insulating housings to secure a plurality of male contacts and female contacts disposed alternatively.

8 Claims, 2 Drawing Sheets

ELECTRICAL CONNECTOR AND CONNECTOR ASSEMBLY

FIELD OF THE INVENTION

The present invention relates to an electrical connector, more specifically to such connector having a plurality of contacts in one or more row.

BACKGROUND OF THE INVENTION

A typical electrical connector comprises an insulating housing and at least one contact secured in the insulating housing. However, as electrical circuits become increasingly complex and with higher performance, it is typical that the plurality of contacts are secured in the insulating housing at smaller centerline spacing or in higher density. In personal computers and many office or business electronic machines such as copiers, facsimile machines, etc., it is typical that a large number of closely spaced contacts are secured in two or more rows in an insulating housing.

One typical example of such connectors is a so-called drawer connector. One connector half is mounted in a main body while another connector half is mounted in a module which is pluggable into a module compartment in the main body. That is, in certain types of electronic machines and equipment such as copy machines are designed such that there are two or more removable parts to be electrically and mechanically integrated for convenience of service and maintenance. One or more drawer connectors are used at the interface between the main body and the module to effect interconnection.

One typical example of such drawer connectors is disclosed in Japanese Patent Publication No. 276575/89. It is typical that hermaphroditic housings are used for connector halves in which the male contacts are disposed in a row and the female contacts are disposed in another row.

Another example of an hermaphroditic connector is disclosed in U.S. Pat. No. 4,737,118. A plurality of contacts of identical construction is disposed in a row in an identical connector housing. A pair of identical housings in a reversed vertical orientation with respect to each other are with the matable contacts engaging with one another.

The conventional drawer or hermaphroditic electrical connectors as mentioned above utilize identical resilient contacts normally curved in one direction which are resiliently biased when mated with one another. In other words, the contacts are identical and act as both male and female contacts. When a pair of such identical connectors are mated with one another, all contacts in one connector cause a pivotal action toward the contacts of the other and also the connector housings in which such contacts are secured.

Such conventional connectors operate satisfactory when the number of contacts is relatively limited and the connector is relatively large in dimension. However, in compact and high performance electronic equipment, contacts are normally secured in the housing in a plurality of rows with small centerline contact pitch. In such applications, contacts of one row are oriented in opposite direction to those of another row to compensate for biasing force to the contacts. However, such compensation is not possible when the contact are disposed in an odd number of rows, for example, 3 rows. Also, the insertion force of the conventional hermaphroditic contacts is relatively high and not practical for electrical connector having a large number of contacts.

It is therefore an object of the present invention to provide an electrical connector having a large number of contacts with small spacing therebetween.

It is another object of the present invention to provide a low insertion force electrical connector assembly having hermaphroditic housing and contacts.

It is still another object of the present invention to provide an electrical connector having an odd number of rows of contacts.

SUMMARY OF THE INVENTION

In order to solve the above problems of the conventional electrical connectors and achieve the above objects, the electrical connector according to the present invention has a plurality of deflectable and nondeflectable contacts disposed alternately in at least one row in an insulating housing, thereby offsetting or balancing any undesirable forces that may be applied to the housing. The nondeflectable contacts of each row are supported by a housing wall surface toward which the deflectable contacts of that row are deflected during mating as the contacts are engaged by deflectable and nondeflectable contacts of the mating connector, respectively.

Also, the connector assembly according to the present invention comprises a pair of identical or hermaphroditic housings having a plurality of contact receiving cavities and a plurality of nondeflectable and deflectable contacts disposed alternately in each row of the contact receiving cavities in the housings.

Preferred embodiments of the electrical connector according to the present invention will be described in detail by reference to accompanying drawings in which:

DETAILED DESCRIPTION

Figure 1:
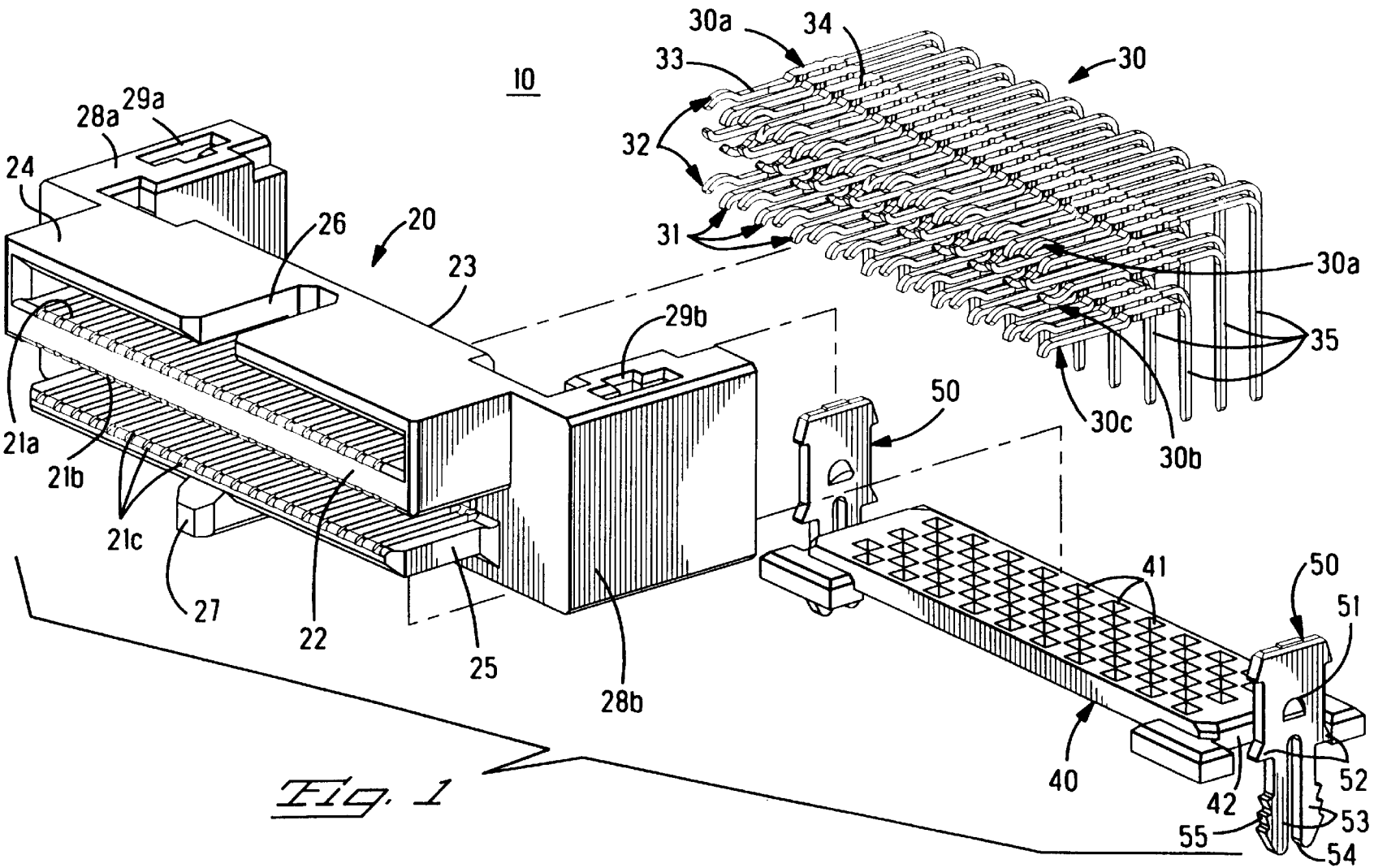
FIG. 1 is an exploded isometric view of one preferred embodiment of the electrical connector made in accordance with the present invention.

Illustrated in FIG. 1 Is an exploded isometric view or the electrical connector of the present invention. The electrical connector 10 comprises an insulating housing 20, a plurality of right angle contacts 30, a pin alignment plate 40 and a pair of board retention members 50. The electrical connector 10 is designed to be mounted on a circuit board (see FIG. 3).

The insulating housing 20 has three rows of contact receiving cavities 21*a*,21*b*,21*c* from its mating face 22 to its rear face 23. A first row of contact cavities 21*a* is in a shroud 24 along an inner surface of an inner shroud wall. A second row of contact receiving cavities 21*b* is on the bottom face of the shroud 24 inner wall while a third row of contact receiving cavities 21*c* is on the upper face of a rib 25 separated from and in parallel with the shroud 24. A slot 26 is formed in the outer wall of the shroud 24 while a guide projection 27 is formed on the bottom face of the rib 25. A pair of mounting flanges 28*a*,28*b* are formed at both ends of the insulating housing 20 extending rearwardly in parallel with each other. A pair of openings 29*a*,29*b* are formed in and extend through the mounting flanges 28*a*,28*b* for receiving the board retention members 50.

Now, the contacts 30 comprise three rows of right-angle contacts 30*a*,30*b*,30*c* to be received in the contact receiving cavities 21*a*,21*b*,21*c* in the insulating housing 20, respectively. Each row of contacts 30*a*–30*c* contacts nondeflectable or male contacts 31 and deflectable or female contacts 32 disposed alternately. Each of the male contacts and female contacts 31,32 comprises a contact section 33, a retention section 34 and a solder tail 35 bent at a substantially right angle. The contact section 33 of each male contact 31 is supported by a wall surface of the housing, while the contact section 33 of each female contact 32 is spaced from that wall surface in order to be deflectable towards that wall surface during mating.

Each row of contacts 30*a*–30*c* is made by stamping and forming an electrically conductive metal plate or strip. The solder tail 35 of each contact 31,32 is substantially a pin contact having a generally rectangular cross-section. The contact section 33 of the male contact 31 is generally straight but curved downwardly at the front or mating end while that of the female contact 32 has raised semicircular portion at the front end.

The pin alignment plate 40 is made from an insulative material and is generally a plate member having a plurality of openings 41 equal in number to the number of contacts 30. As apparent from FIG. 1, the openings 41 to receive solder tails 35 are disposed in 6 rows that is two columns of three openings in an alternating pattern, while the contact sections 33 of the contacts 30 are disposed in 3 rows of contact receiving cavities 21*a*–21*c* as mentioned above. In addition, the openings 41 in the pin alignment plate 40 are offset in alternate rows so that the openings 41 will make a straight line obliquely or about 45 degrees with respect to the edge of the pin alignment plate 40. The pin alignment plate 40 also has a pair of slots or cut-outs 42 at both ends to receive the board retention members 50.

The board retention members 50 are made from a generally flat metal plate by conventional stamping techniques. Each board retention member 50 has a generally flat retention or base section 51 having a few barbs 52 on side edges and a pair of resilient legs 53 separated by a vertical slot 54. The outer edges of the retention legs 53 have barbs or serrations 55 to bite into an inner wall of a hole in a circuit board as known in the art.

Preferably the board retention members 50 are inserted through aligned slots 42 and the openings 29 in the insulating housing 20 from the bottom of the insulating housing 20, thereby firmly securing the pin alignment plate 40 and the insulating housing 20. Needless to say that the pin alignment plate 40 is mounted on the insulating housing 20 from the bottom with the solder tails 35 of the contacts 30 passing through the openings 41. Alternatively, the pin alignment plate 40 may be retained by friction force in the insulating housing 20, thereby eliminating the slots (or cut-out portions) 42.

Figure 2:
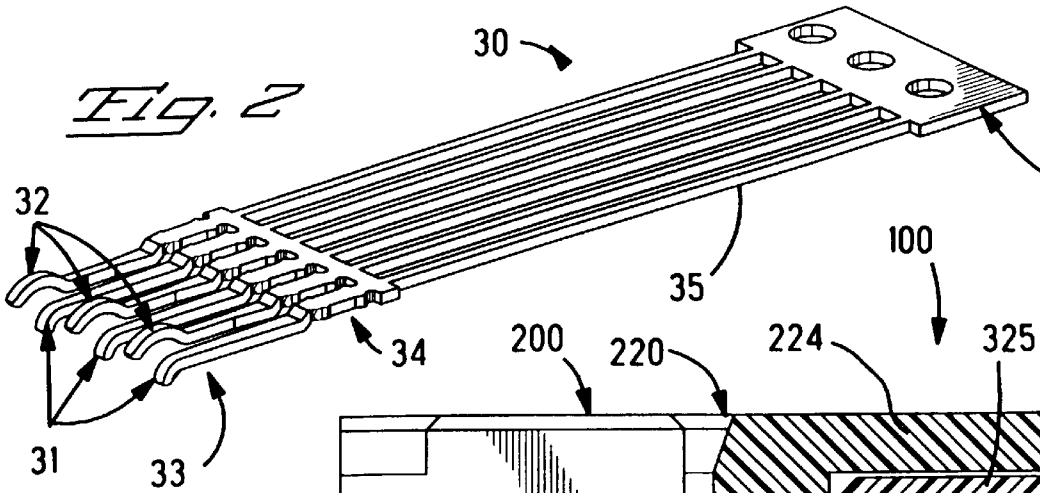
FIG. 2 is an isometric view of several contacts to be used in the electrical connector in FIG. 1.

Now, illustrated in FIG. 2 is a part of the contacts 30 which are integrally formed along a carrier strip 39 by stamping a metal strip. It is preferable that the contacts 30 are also intercoupled at the retention section 34 until they are severed from the carrier strip 39 for assembly with the insulating housing 20. Note that male and female contacts 31, 32 are formed alternately and desired number of male and female contacts are removed from the carrier strip 39 and bent at a different locations for the different rows of the contacts 30*a*–30*c*.

It is to be noted that the first, second and third rows of contacts 30*a*–30*c* may be made of identical contacts. In other words, the contacts 30*a*–30*c* are identical to one another except the length of the solder tails 35. This means that the contact strip is preferably designed in accordance with the contacts 30*a* having the longer solder tails 35 and the second and third rows of contacts 30*b*, 30*c* are made by cutting the solder legs 35 at gradually shorter locations. In this way, the total production cost can be minimized.

Figure 3:
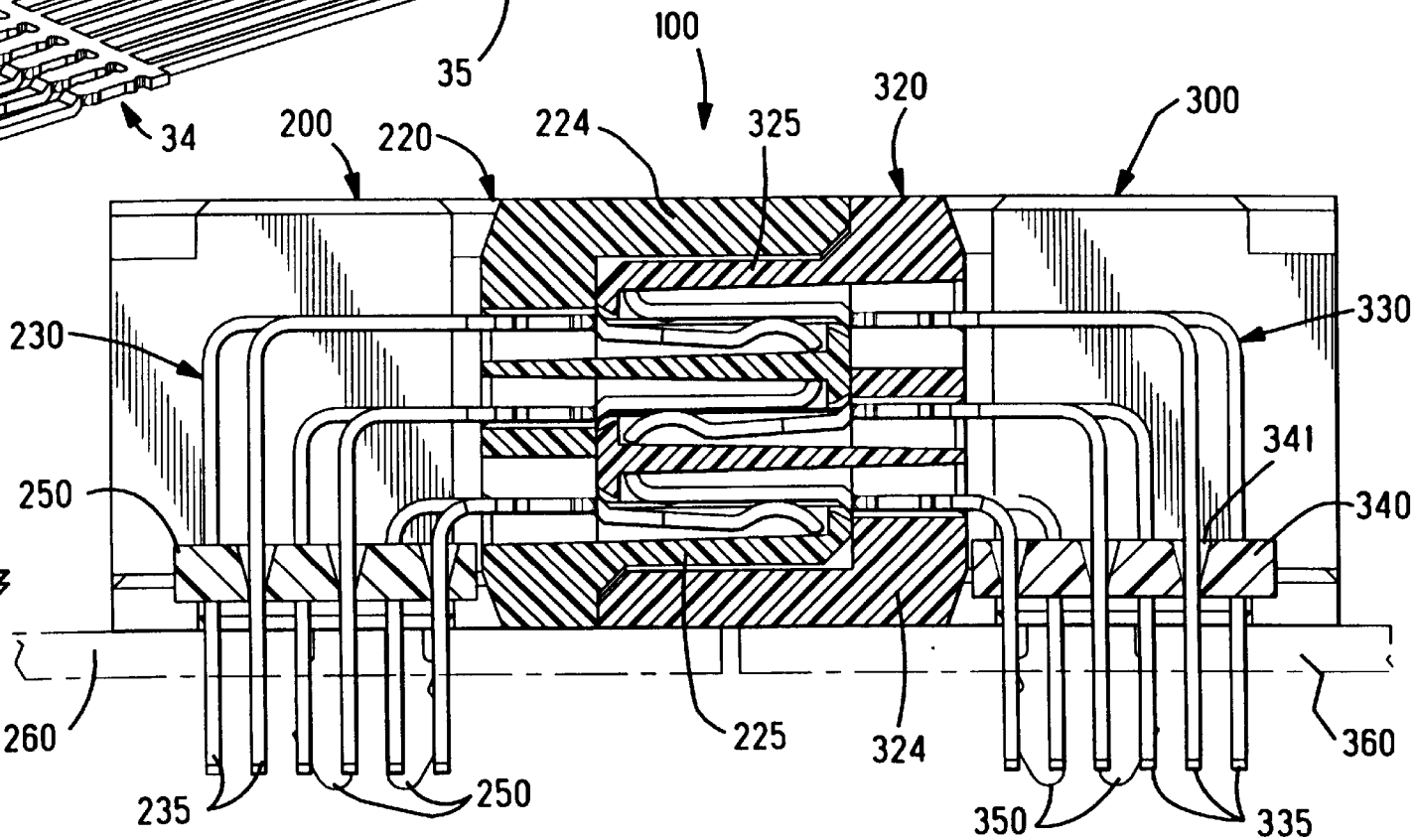
FIG. 3 is a cross-sectional view of one preferred embodiment of a mated connector assembly of the hermaphroditic electrical connector in accordance with the present invention.

Illustrated in FIG. 3 is a longitudinal cross-sectional view of a mated connector assembly 100 according to the present invention. The connector assembly 100 comprises a pair of hermaphroditic electrical connectors 200, 300 which are substantially identical to the electrical connector 10 in FIG. 1 and to be mounted on respective co-planar circuit boards 260, 360 near edge portions thereof.

More in detail, the electrical connector 200 is identical to the electrical connector 10 while the electrical connector 300 uses the same insulating housing 320 as the insulating housing 20 in FIG. 1 but in the up-side-down relationship. That is, the electrical connectors 200 and 300 are hermaphroditic to each other. The insulating housing 220 of the first electrical connector 200 is right-side-up and the shroud 224 is located at the upper or remote position from the circuit board 260. On the other hand, the insulating housing 320 of the second electrical connector 300 is up-side-down with respect to housing 220, and its shroud 324 is located at the lower or closer position to the circuit board 360. In this arrangement, the rib 325 of the second insulating housing 320 is received in the shroud 224 of the insulating housing 220 while the rib 225 of the first insulating housing 220 is received in the shroud 324 of the insulating housing 320. Also, the guide projections and the slots 26 of the both electrical connectors 200, 300 are intermated with each other. Additionally, as seen in FIG. 3, pin alignment plate 40 is mounted to the housing 20 on the shroud side of the housing proximate circuit board 360. The solder tails 335 of contacts 330 are bent to be received in the openings 341 of plate 340.

As shown in FIG. 3, the contacts 230, 330 of both electrical connectors 200, 300 are intermated with each other. It should be noted here that the male contacts 231 of the first electrical connector 200 mate with the female contacts 332 of the second electrical connector 300 and that the female contacts 232 of the first electrical connector 200 mate with the male contacts 332 of the second electrical connector 300. Also, it should be noted that the male contacts 231, 331 in one row of the contacts 230, 330 correspond to the female contacts 232, 332 in adjacent row or rows of the contacts 230, 330. This arrangement thus minimizes the stress to the insulating housings 220, 320 due to the biasing force applied to the intermatable contacts 230, 330. The spacing between adjacent rows of contact receiving cavities and thus the contacts inserted therein is maintained constant by the arrangement.

The preferred embodiments of the electrical connector and the connector assembly according to the present invention have been described in detail hereinbefore. However, it is to be understood that the present invention is not limited to the shown embodiments and various modifications can be made without departing from the subject matter of the present invention. For example, the board locks 50 may be any other conventional design as shown in Japanese UM Publication No. 42645/89 and U.S. Pat. No. 5,336,111. The pin plate 40 may have a plurality of slots extending from one (outer) edge of such plate rather than openings. Such a pin alignment plate is shown in many prior art publications including U.S. Pat. Nos. 5,037,334, 5,167,531 and 5,336,109. In such arrangement, the pin alignment plate may be slidably assembled with the board retention members of the electrical connector. Alternatively, the pin alignment plate may be integrally formed with the insulating housing rather than a separate plate. Also, the contacts 30 may have straight solder tails rather than solder tails bent at right angle. In such a design, the circuit boards 260, 360 would be disposed parallel to each other.

As apparent from the above description and the illustrated drawings, the electrical connector and the electrical connector assembly feature the use of the plurality of male and female contacts disposed alternately in a line or row. Accordingly, any force to be applied to the insulating housing by the normal force of the intermating contacts is minimized, thereby achieving high density hermaphroditic or drawer connector having a large number of contacts in desired number of rows, for example, 3 rows. Most importantly, the intermating of the alternating male and female contacts reduces the insertion force of the electrical connector assembly.

What is claimed is:

1. An electrical connector (10,300) having a plurality of first and second contacts (31,32) in and alternating along at least a first row (30*a*) in an insulating housing (20,320) with respective contact sections (33) disposed along a mating face (22) to mate with complementary second and first contacts (232,231) of a matable connector (200), characterized in that:

said contact sections (33) of said first contacts (31) of said first row (30*a*) are always supported against deflection by a wall surface of said housing (20,320) associated with said first row (30*a*), and said contact sections (33) of said second contacts (32) of said first row (30*a*) are spaced from and deflectable in a common direction toward said wall surface of said housing, whereby upon mating with said matable connector (200) said contact sections (33) of said second contacts are deflectable toward said wall surface upon mating with said first contacts (231) of said matable connector (200), and remain biased thereagainst after mating.

2. The connector (10,300) of claim 1 wherein a second said row (30*b*) of first and second contacts (31,32) extends across said mating face (22) spaced from said first row (30*a*), and said contact sections (33) of said first contacts (31) of said second row (30*b*) are supported against deflection upon mating by a second wall surface of said housing (20,320) associated with said second row (30*b*), and said contact sections (33) of said second contacts (32) of said second row (30*b*) are spaced from and deflectable upon mating in a common direction toward said second wall surface, where said common direction of deflection of said contact sections (33) of said second contacts (32) of said second row (30*b*) is the same as said common direction of deflection of said contact sections (33) of said second contacts of said first row (30*a*).

3. The connector (10,300) of claim 2 wherein a shroud (24) and a rib (25) spaced from and parallel to said shroud extend forwardly at the mating face (22) of said housing (20,320), and said first row (30*a*) being disposed on an inner surface of an inner wall of said shroud (24) and a second row (30*b*) being disposed on said rib (25) facing said inner wall of said shroud, whereby upon mating of said connector with an identical other housing (220) in a reversed vertical orientation to said housing (20,320), said shroud (24) receives a rib (225) of the other housing and said contacts of the respective shrouds (24,224) engage with contacts of the ribs (25,225) of the opposite housing.

4. The connector (10,300) of claim 2 wherein a third said row (30*c*) of first and second contacts (31,32) extends across said mating face (22) spaced from and between said first row (30*a*) and said second row (30*b*), and said contact sections (33) of said first contacts (31) of said third row (30*c*) are supported against deflection upon mating by a third wall surface of said housing associated with said third row (30*c*), and said contact sections (33) of said second contacts (32) of said third row (30*c*) are spaced from and deflectable upon mating in a common direction toward said third wall surface, where said common direction of deflection of said contact sections (33) of said second contacts (32) of said third row (30*c*) is opposed to said common direction of deflection of said contact sections (33) of said second contacts (32) of said first and second rows (30*a*,30*b*).

5. The connector (10,300) of claim 4 wherein said housing (20,320) includes a shroud (24) and a rib (25) parallel thereto and spaced therefrom, said first and third wall surfaces are opposed surfaces of an inner wall of said shroud (24), said second wall surface is a surface of said rib (25) and faces said first wall surface defining a space therebetween, whereby upon mating with said matable connector (200), said shroud receives thereinto a rib (225) of said matable connector (200), and said spaced between said first and second wall surfaces receives thereinto an inner shroud wall of said matable connector (200) as said rib (25) is received into a shroud (224) of said matable connector.

6. The connector (10,300) of claim 1 further including a pin alignment plate 40), wherein said housing (20,320) includes mounting flanges (28*a*,28*b*) extending rearwardly from ends thereof, said flanges including openings (29*a*,29*b*) extending therethrough for receiving board retention members (50), said flanges being adapted to receive a pin alignment plate (40) for receiving solder tails (35) of said contacts (31,32).

7. A connector assembly (200,300) comprising a pair of insulating housings (220,320) and a plurality of contacts secured in each of said insulating housings in at least a first row (30*a*), where said insulating housings (220,320) are hermaphroditic, and said contacts in each insulating housing comprise first and second contacts (231,232;331,332) alternately disposed in a row to mate with second and first contacts (232,231;332,331) in the other insulating housing, characterized in that:

said contact sections (33) of said first contacts (231,331) of a said first row of each said housing (220,320) are always supported against deflection by a wall surface of said housing associated with said first row, and said contact sections (33) of said second contacts (232,332) of said first row are spaced from and deflectable in a common direction toward said wall surface of said housing (220,320) upon mating with said first contacts (331,231) of the other connector (300,200), remaining biased against said first contacts of the other connector after mating.

8. The connector assembly (200,300) of claim 7 wherein each of said housings (220,320) includes a plurality of rows (230,330) of contacts, each row including alternately disposed first and second contacts (231,232;331,332) such that upon rotating and aligning the two housings (220,32O) for mating, the first and second contacts of each row are positioned for mating with complementary contacts (332, 331;232,231) in the other housing (320,220).

* * * * *